US005211709A

United States Patent [19]

Hussey

[11] Patent Number: 5,211,709

[45] Date of Patent: May 18, 1993

[54] STOP MOTION DEVICE FOR STRAND PROCESSING MACHINE

[75] Inventor: John W. Hussey, Lake Wylie, S.C.

[73] Assignee: MHT, Inc., Lake Sylie, S.C.

[21] Appl. No.: 773,518

[22] Filed: Oct. 9, 1991

[51] Int. Cl.[5] ..... D01H 13/18; B65H 63/06

[52] U.S. Cl. ..... 57/87; 28/227; 57/83; 57/86; 242/19; 242/36; 242/37 R

[58] Field of Search ..... 57/80–81, 57/83, 86–87; 242/19, 36, 37 R; 28/226, 227

[56] References Cited

U.S. PATENT DOCUMENTS

| | | | |
|---|---|---|---|
| 2,611,230 | 9/1952 | Saunders et al. | 57/87 |
| 2,734,335 | 2/1956 | Saunders et al. | 57/86 |
| 2,964,254 | 12/1960 | Rosenkranz et al. | 242/19 |
| 3,102,378 | 9/1963 | Walker | 57/87 |
| 3,758,925 | 9/1973 | Desaulniers et al. | 242/36 X |
| 3,854,356 | 12/1974 | Okreglak | 28/226 X |
| 4,202,506 | 5/1980 | Rohner | 242/37 R |
| 4,330,094 | 5/1982 | Mayer | 57/81 X |
| 4,376,516 | 3/1983 | Leo | 242/36 |
| 4,404,791 | 9/1983 | Wolf et al. | 57/80 |
| 4,418,522 | 12/1983 | Harrop et al. | 57/80 |
| 4,922,702 | 5/1990 | Meyer | 57/87 |
| 5,036,568 | 8/1991 | Goineau | 57/264 X |
| 5,044,150 | 9/1991 | Stahlecker | 57/83 X |

FOREIGN PATENT DOCUMENTS

| | | | |
|---|---|---|---|
| 2183260 | 6/1987 | United Kingdom | 57/80 |

*Primary Examiner*—Daniel P. Stodola
*Assistant Examiner*—William Stryjewski
*Attorney, Agent, or Firm*—W. Thad Adams, III

[57] ABSTRACT

A stop motion device for a textile strand processing machine including a sensor positioned between a supply package and a take-up package for sensing the presence or absence of a strand within a defined sensing range of the sensor and a strand breaker positioned between the supply package and the sensor. The strand breaker includes a pivot for pivotally mounting the strand breaker for movement between an inoperative position in disengagement with the strand and a strand breaking position in engagement with the strand. The pivot is positioned with relation to the path of movement of the strand for pivotal movement of the strand breaker in the direction of movement of the strand and towards and into the path of movement of the strand for breaking the strand upstream of the take-up package. A release cooperates with the sensor and the strand breaker for releasing the strand breaker when the sensor senses the absence of a strand within its sensing range.

9 Claims, 7 Drawing Sheets

STOP MOTION DEVICE FOR STRAND PROCESSING MACHINE

TECHNICAL FIELD AND BACKGROUND OF THE INVENTION

This invention relates to a stop motion device for a strand processing machine such as a textile spinning frame. While the specific disclosure of this application relates to a textile spinning frame, the invention has application to other types of strand processing machines, as well. In general, the invention provides a novel and unique apparatus and method of interrupting the supply of the strand to the processing station of the machine when the strand is no longer being fed to the take-up package.

Such an occurrence can create serious and even dangerous situation in the operation of the machine. In the case of a spinning frame, as disclosed below, a breakage of the spun yarn downstream of the drafting rollers can create a situation where the sliver being fed to the drafting rolls begins to "lap-up" around the drafting rolls. If this condition is not immediately detected, the sliver can wrap so tightly against and around the drafting rolls the removal becomes a time-consuming task. Yet, with the increasing use of high-speed automated machines fewer human attendants are used making prompt lap-up detection less likely.

Lap-ups create at least the problem of cutting the sliver away from the drafting rolls. This is done with very sharp knife which if not used properly can cut and damage the rubber covering of the top drafting roll. If the damage is slight, it may not be immediately noticed but can drastically increase the incidence of broken ends. More serious damage will usually be noticed, but of course requires replacement of the drafting rolls and removal and recovering of the damaged ones.

Extremely large lap-ups can damage the machine by wrenching the top rolls out of their mounts and warping and otherwise damaging the drafting roll components.

Machine attendants also occasionally cut themselves with the very sharp knifes required to remove the sliver from the drafting rolls.

If the sliver does not lap-up, it is sucked into a vacuum tube. This material is called "waste." The waste must be disposed of or added back with the raw fiber being produced.

Stop motion devices are known which attempt to regulate this problem. However, these devices are characterized by the use of solenoids which must travel relatively long distances, must hold a heavy force and must hold it for a long period of time. All of these prior art features are serious impediments to effective and efficient detection and prevention of lap-ups.

The present invention uses a very small solenoid which must move only a short distance and is not required to hold any weight during its activation mode. Momentary movement of the solenoid activates a mechanical system, for example a tearing blade, which separates the sliver and prevents wrapping of the sliver around the drafting rolls.

SUMMARY OF THE INVENTION

Therefore, it is an object of the invention to provide a stop motion device which interrupts the supply of the strand to the processing station of the machine when the strand is no longer being fed to the take-up package.

It is another object of the invention to provide a stop motion device which accurately detects the absence of a strand within a detection range and activates to prevent continued feeding of the strand to the processing station.

It is another object of the invention to provide a stop motion device which requires very low power consumption and occupies a very compact area. It is another object to use stored kinetic energy in the form of a torsional spring to engage the strand interrupting device.

It is another object of the invention to provide a stop motion device which activates a mechanical strand interrupting device which itself provides the force necessary to stop the feeding of the strand.

It is another object of the invention to provide a method of stopping the delivery of a strand from a strand supply package to a strand processing station upon interruption of the delivery of the strand from the strand processing station to a strand take-up package downstream of said strand processing station.

These and other objects of the present invention are achieved in the preferred embodiments disclosed below by providing a stop motion device for a textile strand processing machine including a sensing means positioned between a supply package and a take-up package for sensing the presence or absence of a strand within a defined sensing range of the sensing means and strand breaking means positioned between the supply package and the sensing means, said strand breaking means including pivot means for pivotally mounting said strand breaking means for movement between an inoperative position in disengagement with the strand and a strand breaking position in engagement with the strand.

Preferably, said pivot is positioned with relation to the path of movement of the strand for pivotal movement of the strand breaking means in the direction of movement of the strand and towards and into the path of movement of the strand for breaking the strand upstream of the take-up package. Release means cooperate with said sensing means and said strand breaking means for releasing said strand breaking means when said sensing means senses the absence of a strand within its sensing range.

According to one preferred embodiment of the invention, the apparatus includes block means positioned on a side of the path of movement of the strand opposite the strand breaking means for engaging the strand breaking means when said strand breaking means is in its strand-breaking position and trapping and breaking the strand therebetween.

According to another preferred embodiment of the invention, said strand breaking means comprises a blade having a plurality of strand engaging and tearing teeth thereon.

According to yet another preferred embodiment of the invention, said sensing means comprises an infrared light transmitter for transmitting an infrared light onto the strand and a reflective infrared receiver for detecting infrared light reflected to the receiver by the strand if the strand is present within the sensing range of the sensing means.

According to one preferred embodiment of the invention, release means comprises a locking pin positioned on said yarn breaking means, a plunger biased towards said yarn breaking means, a disk positioned between said plunger and said yarn breaking means and biased for movement between a first position wherein a pin-engaging surface on said disk engages said locking pin to hold the strand breaking means in its inoperative position, and a second position wherein said pin is released and said disk releases said strand breaking means. A torsional spring is loaded or has kinetic energy from a manual reset lever. This spring provides the force to rotate the strand breaking means into a position to engage the strand. The disk also defines a plunger-engaging surface for engaging said plunger. Plunger activating means said plunger from said plunger-engaging surface of said disk and release said disk to permit said disk to move into said second position when said sensing means senses the absence of a strand within its sensing range.

An embodiment of the method according to the invention comprises the steps of sensing the presence or absence of a strand within a defined sensing range upstream of the processing station and downstream of the supply package, upon the sensing of the presence of a strand within the sensing range, maintaining a strand breaking means in a normally inoperative position, upon the sensing of the absence of a strand within the sensing range, moving the strand breaking means from the inoperative position to a strand breaking position in engagement with the strand downstream of said supply package and upstream from said yarn processing station and breaking the strand upstream of the strand processing station and the take-up package.

According to one preferred embodiment of the invention, the method includes the step of positioning and pinching the strand between first and second strand breaking members in order to break the strand. The first strand breaking member comprises a moving blade having a plurality of strand engaging and tearing teeth thereon and the second strand breaking member comprises a stationary block which the moving blade engages.

According to another preferred embodiment of the invention, the step of sensing the strand comprises the steps of transmitting an infrared light onto the strand and reflecting infrared light to an infrared receiver for detecting infrared light if the strand is present within the sensing range of the sensing means.

According to yet another preferred embodiment of the invention, the step of moving the strand breaking means from the inoperative position to a strand breaking position in engagement with the strand comprises the steps of providing a locking pin positioned on said yarn breaking means, providing a plunger biased towards said yarn breaking means, providing a disk positioned between said plunger and said yarn breaking means and biased for movement between a first position wherein a pin-engaging surface on said disk engages said locking pin to hold the strand breaking means in its inoperative position, and a second position wherein said pin is released and said disk releases said strand breaking means, providing a plunger-engaging surface on said disk for engaging said plunger, withdrawing said plunger from said plunger-engaging surface of said disk, and releasing said disk to permit said disk to move into said second position when said sensing means senses the absence of a strand within its sensing range.

According to yet another preferred embodiment of the invention, the method includes the step of pivotally positioning strand breaking means with relation to the path of movement of the strand for pivotal movement of the strand breaking means in the direction of movement of the strand and towards and into the path of movement of the strand for breaking the strand upstream of the take-up package.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Description and Explanation of Components

Figure 1:
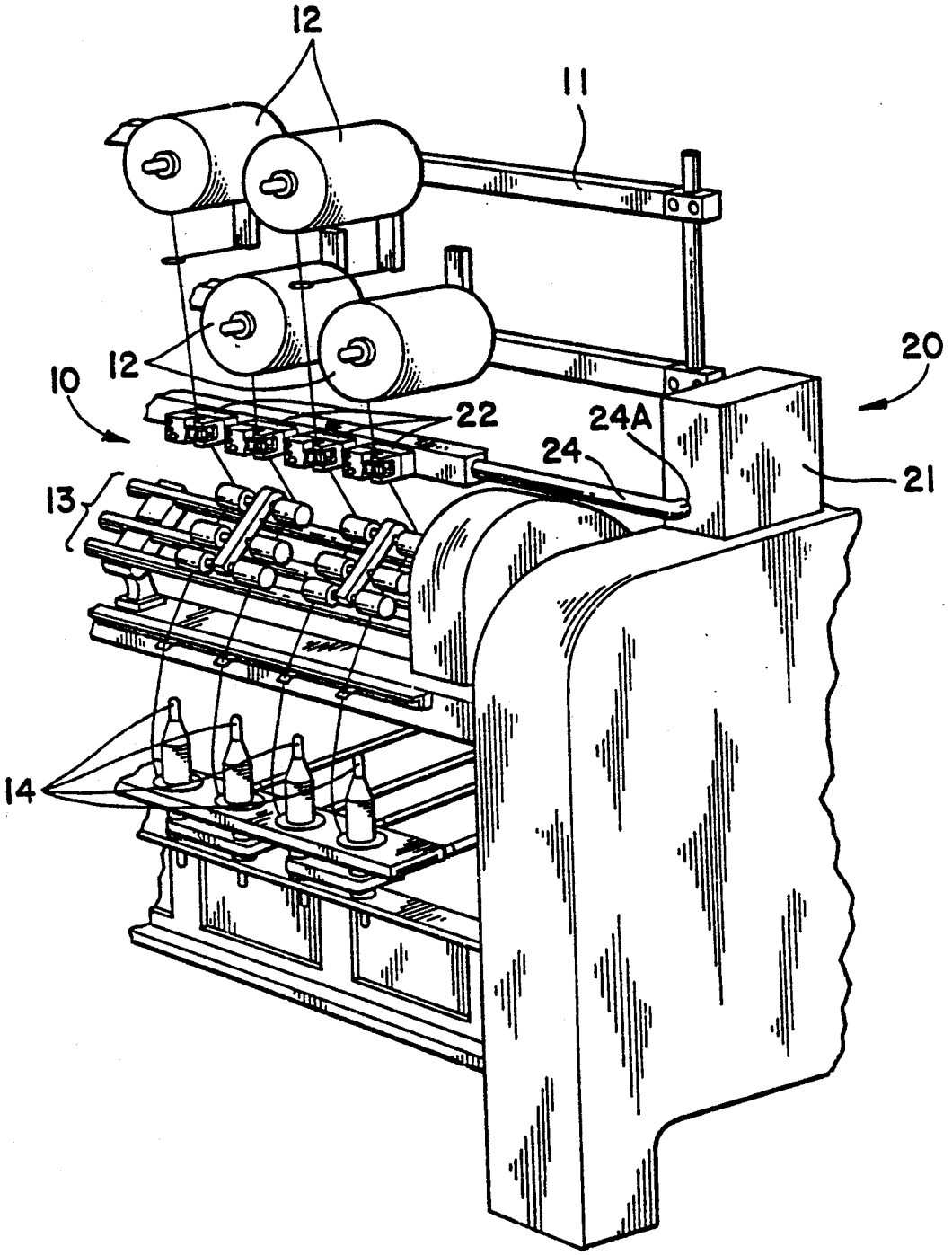
FIG. 1 is an overall, fragmentary perspective view of a yarn spinning frame equipped with the stop motion according to an embodiment of the invention.

Referring now specifically to the drawings, a ring spinning frame of the type on which the stop motion device according to the present invention may be installed is illustrated in FIG. 1 and shown generally at reference numeral 10. The major components of the spinning frame include a creel 11 on which are suspended supply packages 12 of textile sliver which will be drafted and twisted to form spun yarn. Drafting occurs in a drafting zone 13, which comprises three sets or more of top and bottom drafting rolls through which the sliver passes and is successively drafted. The spun yarn is wound onto take-up packages 14 in the form of spindles which are doffed at intervals when the correct amount of yarn has been wound. The terms "sliver", "end" and "strand" are used interchangeably below, it being understood that the stop motion device can be used in numerous other applications.

The stop motion device 20 according to the preferred embodiment of the invention disclosed in this application includes a control panel 21 in which are mounted control and power switches.

Electrical current in the form of 120 V AC is distributed to master circuit boards 82 mounted periodically in the wireway through 23. Each master circuit board 82 can handle up to eight boxes 22. The 120 V AC is transformed to 24 V AC on each master circuit board 82 and is distributed to each box 22 that has its own circuit board 36. On circuit board 36 the 24 V AC electrical current is transformed to 5 V DC and 12 V DC.

Communications between control panel 21 and each box 22 is accomplished by standard four wire cable 24 which is daisy chained from one master circuit board 82 to another alone wireway through 23.

Figure 2:
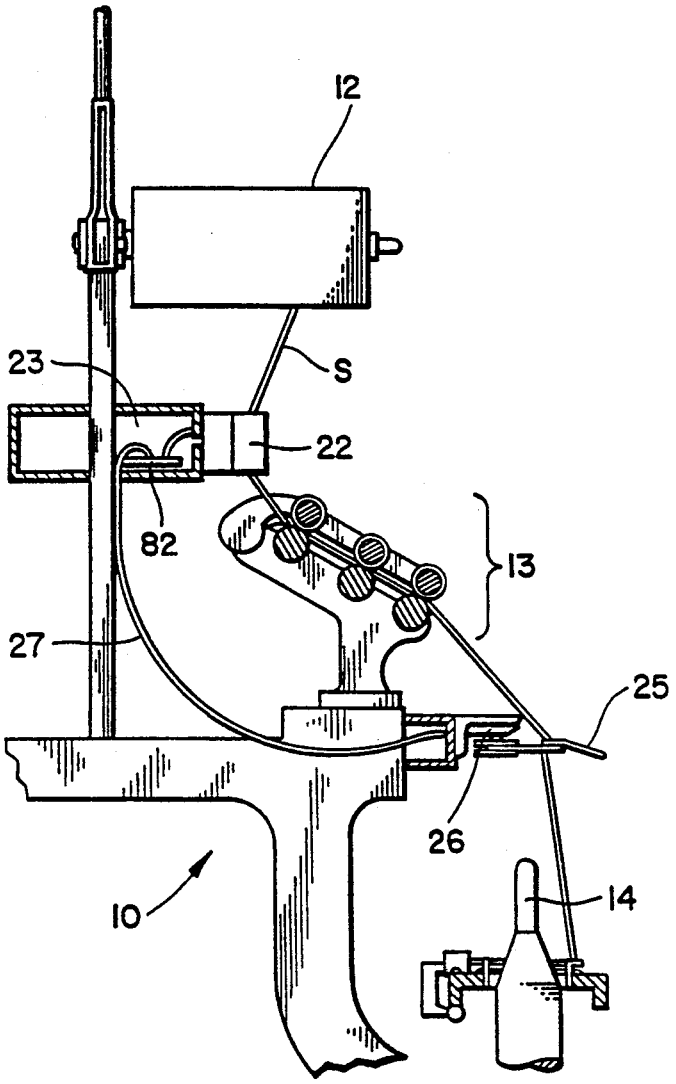
FIG. 2 is a fragmentary side elevation of the portion of the spinning frame where the stop motion device is installed.
Figure 3:
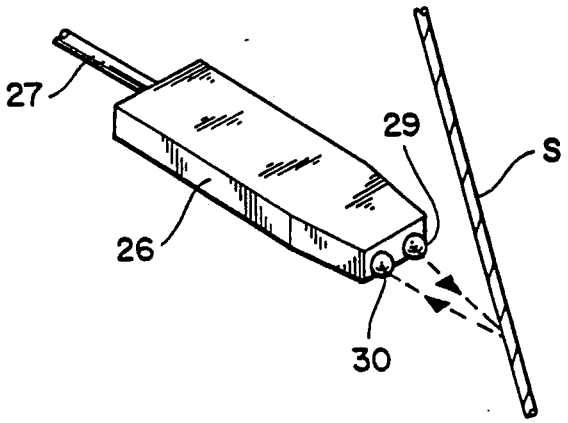
FIG. 3 is a fragmentary perspective view of the infrared sensor.

As is shown in FIG. 2, strand "S" in the form of a sliver passes from the supply package 12 through box 22, then through the drafting zone 13. At the point where the spun yarn is passes through a pigtail guide, the strand "S", now in the form of a spun yarn passes in front of an infrared sensor 26. Infrared sensor 26 is connected by a wire 27 to its respective master circuit board 82 and then to its respective box 22. Infrared sensor 26 operates on a reflective principle. As is shown in FIGS. 2 and 3, infrared light from a light source 29 is transmitted into the path of the strand as it passes from the drafting zone 13 to the pigtail guide 25. Infrared light reflected from the strand is sensed by an infrared light detector 30 positioned adjacent infrared light source 29. Sensing occurs in .05 second intervals, so that should the strand break the absence of reflected light to detector 30 will be almost instantly detected. An absence of the strand for 60 consecutive sensings, which is a three second time interval, activates the stop motion yarn breaker box.

The continuous presence of a strand within the detection range of the infrared sensor 26 maintains the stop motion strand breaking box 22 in an inoperative position and strand processing takes place normally.

Figure 4:
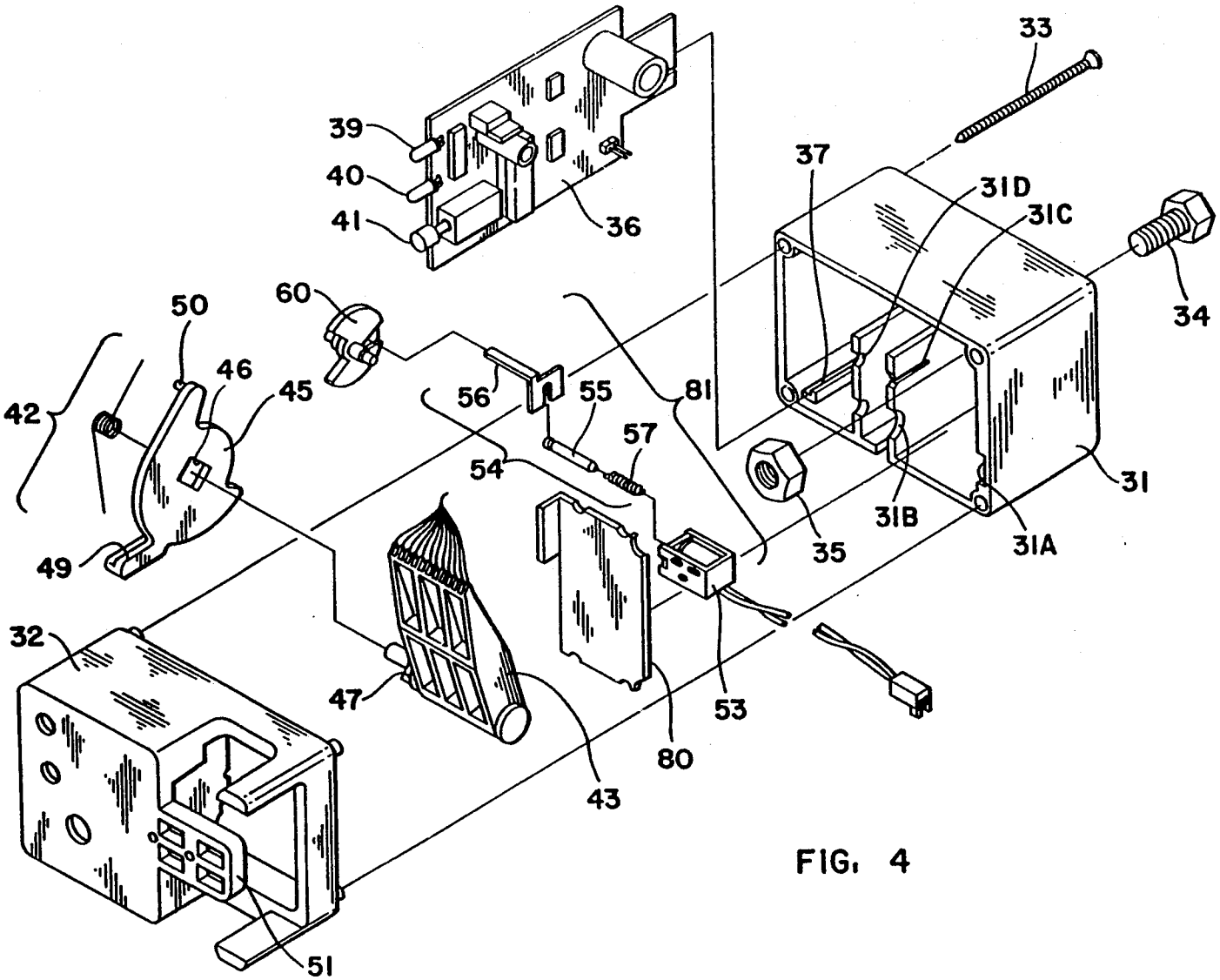
FIG. 4 is an exploded view of the strand breaker and strand breaker release device.

The assembly of stop motion strand breaking box 22 is shown in FIG. 4. Box 22 is formed of two mating box segments 31, 32 which are connected together by four machines screws 33 (one shown). Box 22 is attached to wireway through 23 by two machine bolt 34 and mating nuts 35 (one shown). A control board 36 is mounted vertically in a slot 37 formed in box 22. Control board 36 includes a green "normal" LED 39, a red "alert" LED 40 and a reset button 41.

A yarn breaker 42 is pivotally mounted in recesses 31A and 31B of box segment 31 for movement between an inoperative position and a strand breaking position, as is described below in further detail. Yarn breaker 42 includes a yarn-engaging blade 43 having a plurality of teeth 44 on the strand-engaging end. A control lever 45 is keyed by means of a square hole 46 to a mating segment of a stub shaft 47 on one side of blade 43 for rotation in unison with blade 43. As is also shown in FIG. 4, control lever 45 has a short finger 49 for manual resetting of the yarn breaker 42. In its operative position blade 43 bears against a block 51.

Yarn breaker 42 is released by a small, short throw solenoid 53. A plunger 54 formed of a small plunger rod 55 and an plunger extension 56 is held in a normally extended position by a compression spring 57. The solenoid 53 operates to control movement of a disk 60 pivotally mounted in recesses 31C and 31D of box segment 31.

Referring now to FIGS. 5–10, disk 60 is an asymmetrical structure which sits above the pivot axis of control lever 45. The disk 60 operates with reference to a stop pin 50 and a locking pin 61 positioned on the major surface of control lever 45 facing away from blade 43.

For clarity several of the operating structures of disk 60 and solenoid 53 have been repositioned. The view in FIG. 4 represents the actual arrangement. In FIGS. 5–10 solenoid 53 has been rotated 90 degrees and a solenoid stop shelf 63 on disk 60 has been repositioned from the axial surface to the periphery of disk 60. Disk 60 also includes a spring holding pin 64, a solenoid plunger positioning slot 65 and a sinuous locking pin engaging surface 66. A torsional spring 70 is positioned under disk 60 and held in place against locking pin 61 and spring holding pin 64.

DESCRIPTION AND EXPLANATION OF OPERATION

Figure 5:
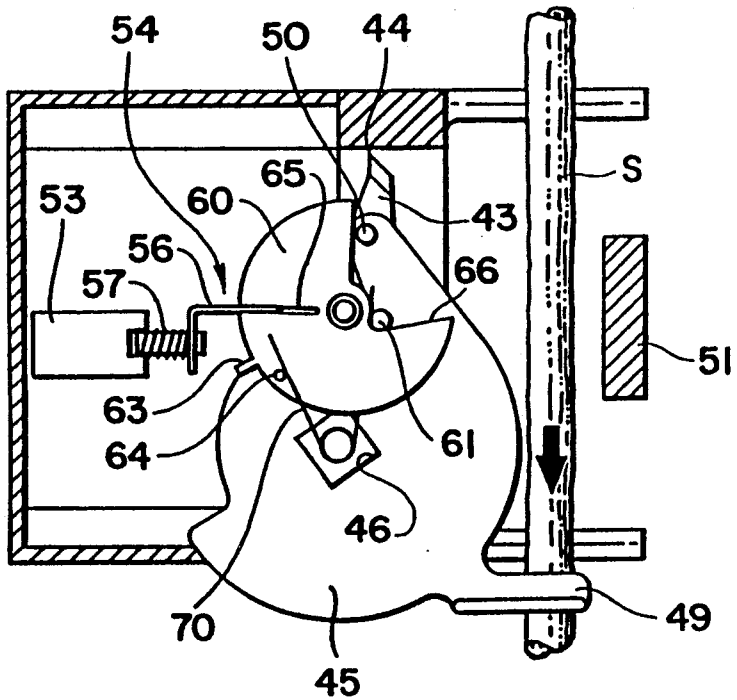

Operation of the stop motion device 20 is explained by continued reference to the Figures. FIG. 5 illustrates normal operation of the spinning frame 10, with stop motion device 20 in a wait state. Strand "S" is extended through a void area in the front end of box 22. Plunger extension 56 is positioned in plunger positioning slot 65, holding disk 60 in a position of near equilibrium in the position shown in FIG. 5. Pin engaging surface 66 holds locking pin 61 and prevents rotation of control lever 45.

During normal operation infrared light from light source 29 is transmitted into the path of the strand as it passes from the drafting zone 13 to the pigtail guide 25 and is reflected from the strand to infrared light detector 30 positioned adjacent infrared light source 29. Sensing occurs at 0.05 second intervals. So long as the strand is sensed as extending from the pigtail guide 25 to the take-up package 14, stop motion device remains in the position shown in FIG. 5. After sixty consecutive 0.05 second interval sensing operations that do not detect a strand, the strand is deemed as not being present. This eliminates not sensing the strand due to the strand vibration and the infrared receiver not detecting a strand that is present.

Figure 6:
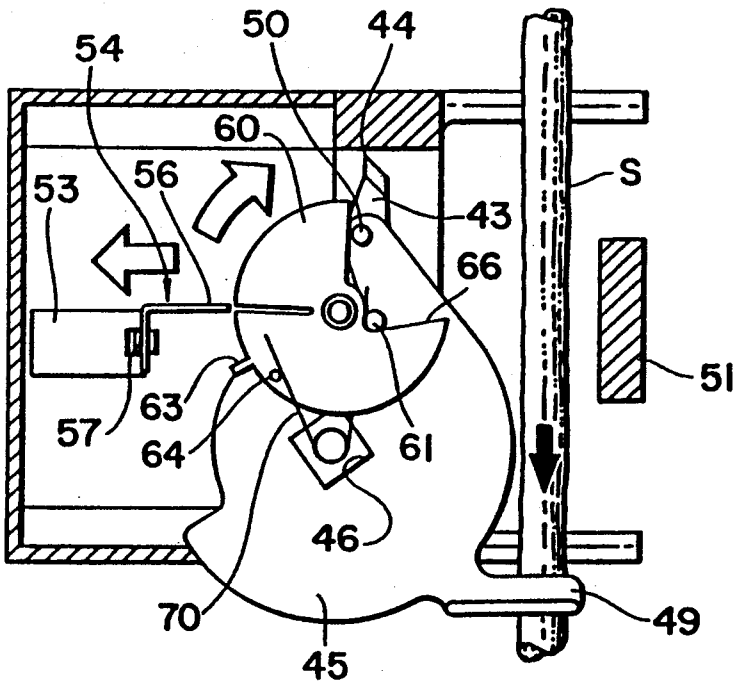
FIGS. 5, 6, 7, 8, 9A, 9B, 10, and 11, inclusive, are partial vertical cross-sections, with parts rearranged for clarity, of the strand breaker and strand breaker release device in sequences of operation.

Should strand break, detector 30 does not sense infrared light reflected from the strand. The red alert light flashes for sixty consecutive 0.05 second time intervals. At the end of this time, as is shown in FIG. 6, solenoid 53 is activated, withdrawing plunger extension 56 from positioning slot 65. Disk 60 is permitted to rotate clockwise. Red alert light 40 is switched on to a continuous red light to signal a machine operator.

Figure 7:
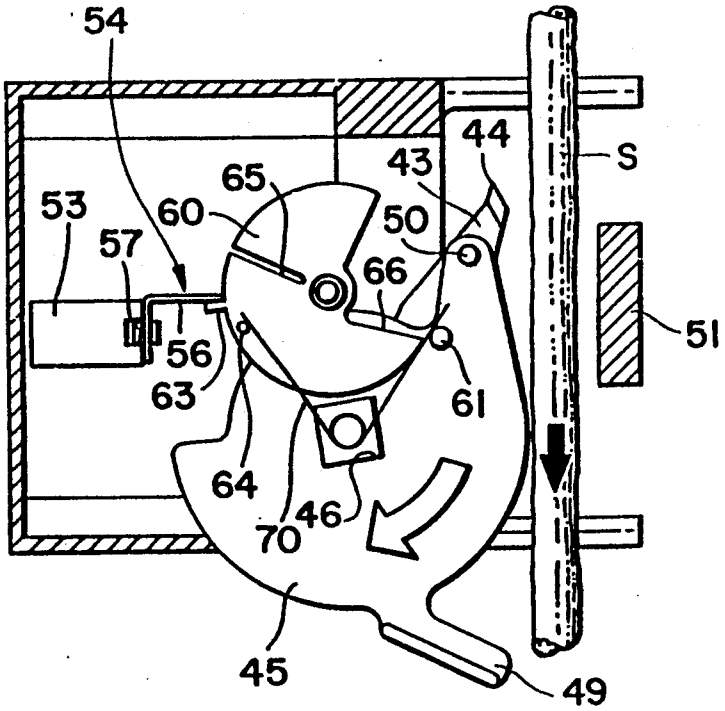
Figure 9B:
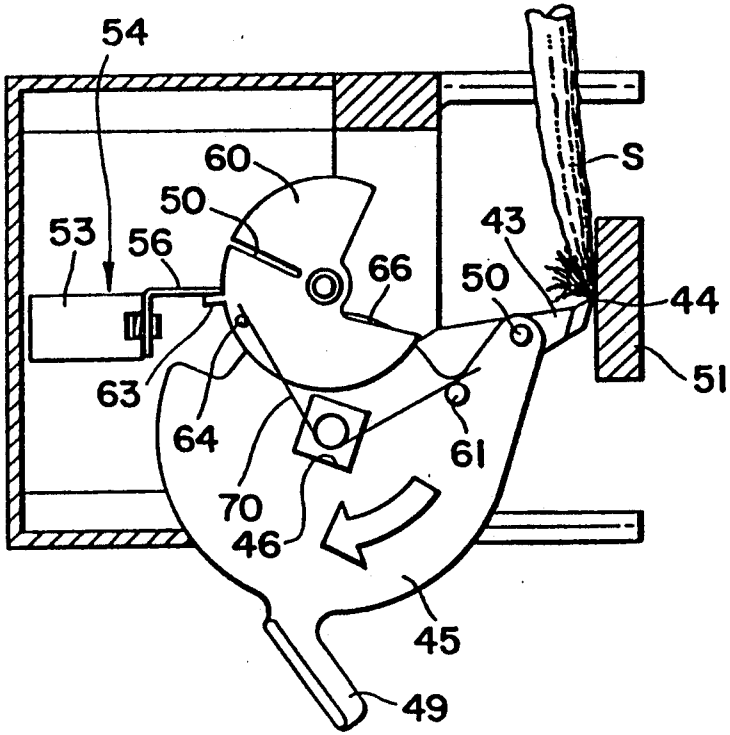
Figure 9A:
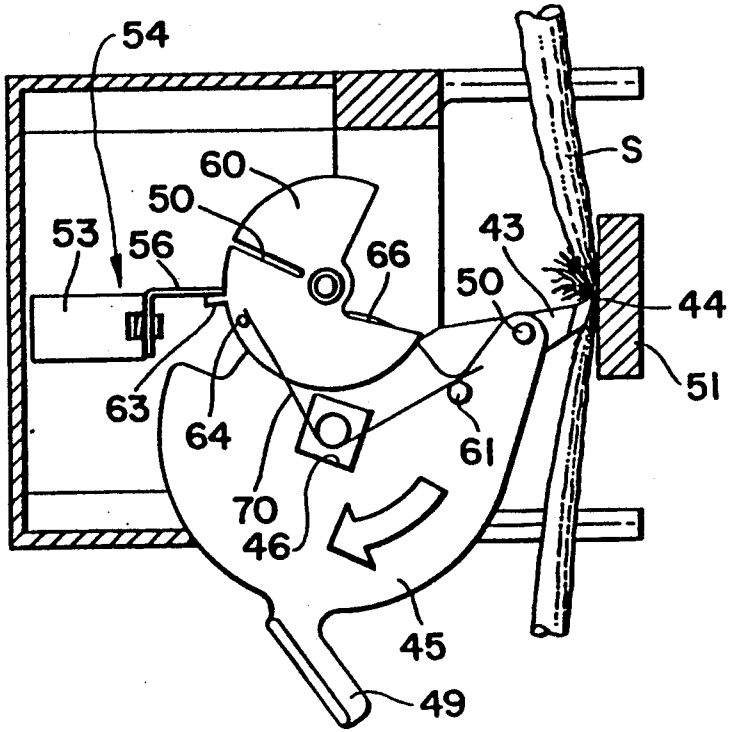

As is shown in FIG. 7, locking pin 61 is permitted to move off of the shoulder defined by pin engaging surface 66. Control lever 45 rotates clockwise by the stored energy provided by torsional spring 70 and in so doing permits blade 43 to rotate clockwise as well towards strand "S." As is also shown in FIG. 7, solenoid 53 withdraws plunger 54 only momentarily and then releases, allowing spring 57 to re-extend plunger extension 56 to move back towards disk 60. Plunger extension 56 catches the solenoid stop shelf 63 and stops the rotation of disk 60.

Figure 8:
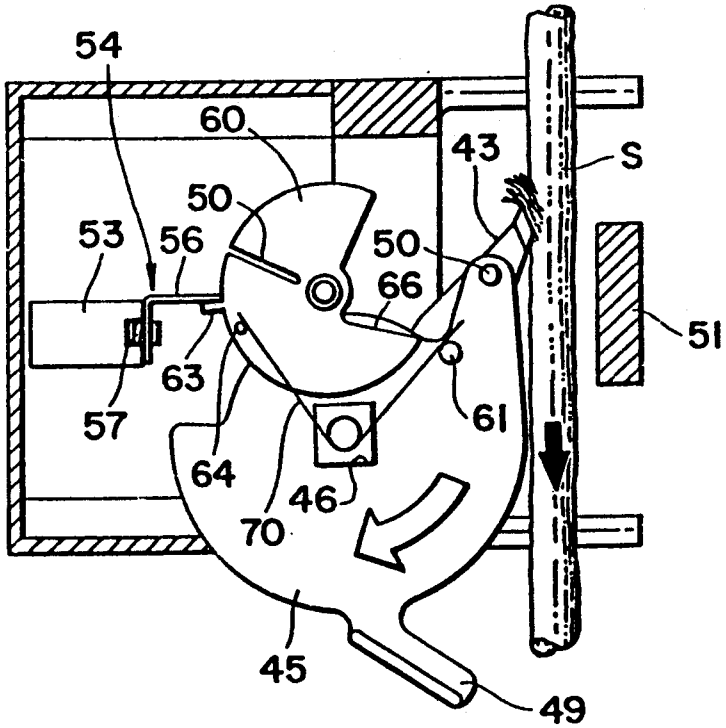

FIG. 8 illustrates the actual strand breaking action of the stop motion device 20. Blade 43 moves into the strand path and teeth 44 engage the strand, once the strand is engaged, the direction of the strand continues to rotate yarn breaker 42. Note the direction of movement of the blade 43 in the direction of movement of the strand and towards and into the path of movement of the strand. As the drafting rollers in the drafting zone 13 continued to pull the strand, blade 43 is pulled more and more tightly against block 51. With the strand being held, the pull of the drafting rolls pulls the strand apart. Thus, the pull of the strand itself supplies the essential force required to sever the strand and prevent lapping of the strand around the drafting rolls.

Figure 11:
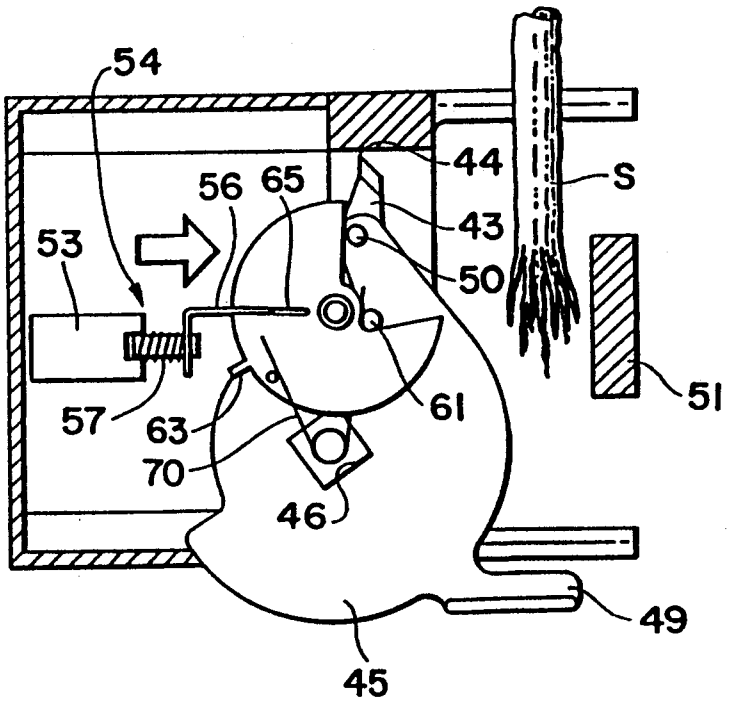
Figure 10:
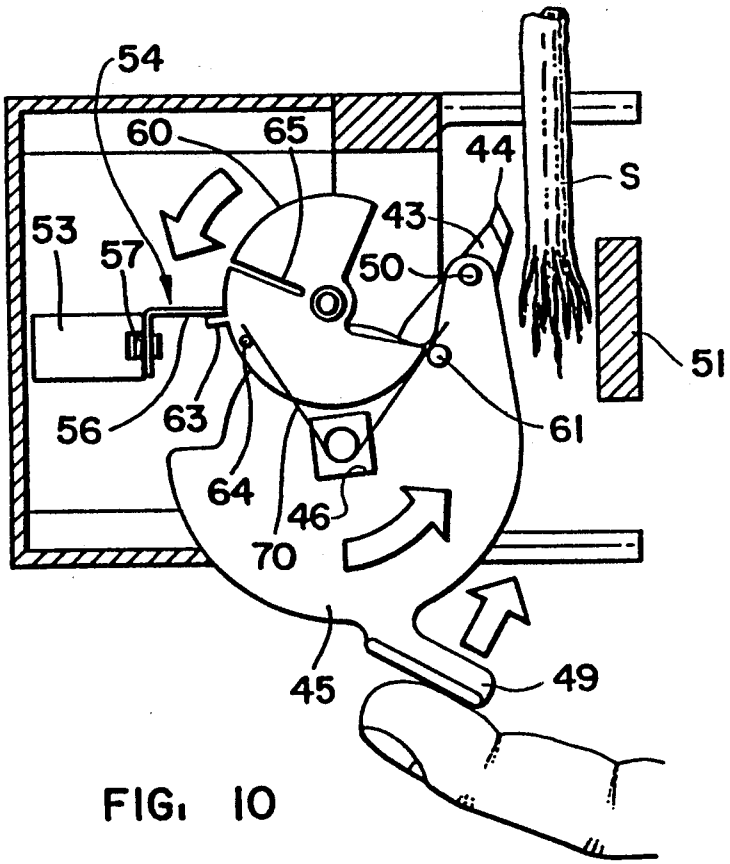

When the machine operator notices the alert light, the end is repaired and the spinning process for that particular spinning position resumes. Before repairing the end, the stop motion device 20 is reset when the operator pushes the finger 49 upwardly. As is shown in FIG. 10, control lever 45 rotates counterclockwise, and the action of spring 70 also rotates disk 60 counterclockwise until plunger extension 56 slips back onto the plunger positioning slot 65. Stop motion device resumes the appearance shown in FIG. 11. The stop motion device circuitry is reset by depressing the reset button 41.

A stop motion device is described above. Various details of the invention may be changed without departing from tis scope. Furthermore, the foregoing description of the preferred embodiment of the invention and the best mode for practicing the invention are provided for the purpose of illustration only and not for the purpose of limitation—the invention being defined by the claims.

I claim:

1. A stop motion device for a textile strand processing machine, comprising:

(a) sensing means positioned downstream of a supply package and upstream of a take-up package for sensing the presence or absence of a strand within a defined sensing range of the sensing means;

(b) strand breaking means positioned downstream of the supply package and upstream of the sensing means, said strand breaking means including pivot means for pivotally mounting said strand breaking means for movement between an inoperative position in disengagement with the strand and a strand breaking position in engagement with the strand; and (c) release means mechanically cooperating with said strand breaking means in response to said sensing means for releasing said strand breaking means when said sensing means senses the absence of a strand within its sensing range, wherein said release means comprises;

(1) a locking pin positioned on said yarn breaking means;

(2) a plunger biased towards said yarn breaking means;

(3) a disk positioned between said plunger and said yarn breaking means and biased for movement between a first position wherein a pin-engaging surface on said disk engages said locking pin to hold the strand breaking means in its inoperative position, and a second position wherein said pin is moved into a disk releasing position and said disk releases said strand breaking means;

(4) said disk also defining a plunger-engaging surface for engaging said plunger; and (5) plunger activating means for withdrawing said plunger from said plunger-engaging surface of said disk and releasing said disk to permit said disk to move into said second position when said sensing means senses the absence of a strand within its sensing range.

2. A stop motion device according to claim 1, wherein said pivot means is positioned with relation to the path of movement of the strand for pivotal movement of the strand breaking means in the direction of movement of the strand and into the path of movement of the strand for breaking the strand upstream of the take-up package and including block means positioned on a side of the path of movement of the strand opposite the strand breaking means for engaging the strand breaking means when said strand breaking means is in its strand-breaking position, said strand breaking means being forced by the movement of the strand into tighter breaking engagement with the strand and with the block means and trapping and breaking the strand therebetween.

3. A stop motion device according to claim 2, wherein said strand breaking means comprises a blade having a plurality of strand engaging and tearing teeth thereon.

4. A stop motion device according to claim 1, wherein said sensing means comprises an infrared light transmitter for transmitting an infrared light onto the strand and a reflective infrared receiver for detecting infrared light reflected to the receiver by the strand if the strand in present with the sensing range of the sensing means.

5. A method of stopping the delivery of a strand from a strand supply package to a strand processing station upon interruption of the delivery of the strand from the strand processing station to a strand take-up package downstream of said strand processing station, and comprising the steps of:

(a) sensing the presence or absence of a strand within a defined sensing range upstream of the processing station and downstream of the supply package;

(b) upon the sensing of the presence of a strand within the sensing range, maintaining a strand breaking means in a normally inoperative position;

(c) upon the sensing of the absence of a strand within the sensing range, moving the strand breaking means from the inoperative position to a strand breaking position in clamping engagement with the strand downstream of said supply package and upstream from said yarn processing station; and (d) positioning the strand breaking means relative to the moving strand so that the strand breaking means increases clamping engagement with the strand by action of the moving strand on the strand breaking means to break the strand upstream of the strand processing station and the take-up package;

(e) wherein the step of moving the strand breaking means from the inoperative position to a strand breaking position in engagement with the strand comprises the steps of:

(1) providing a locking pin positioned on said yarn breaking means;

(2) providing a plunger biased towards said yarn breaking means;

(3) providing a disk positioned between said plunger and said yarn breaking means and biased for movement between a first position wherein a pin-engaging surface on said disk engages said locking pin to hold the strand breaking means in its inoperative position, and a second position wherein said pin is moved into a disk releasing position and said disk releases said strand breaking means;

(4) providing a plunger-engaging surface on said disk for engaging said plunger;

(5) withdrawing said plunger from said plunger-engaging surface of said disk; and (6) releasing said disk to permit said disk to move into said second position when said sensing means senses the absence of a strand within its sensing range.

6. A method according to claim 5, and including the step of positioning and pinching the strand between first and second strand breaking member in order to break the strand.

7. A method according to claim 6, and including the step of providing a plurality of strand engaging and tearing teeth on said first strand breaking member; providing a stationary block on said second strand breaking member and engaging the strand engaging and tearing teeth against the stationary block with the strand trapped therebetween to break the strand.

8. A method according to claim 5, wherein the step of sensing the strand comprises the steps of transmitting an infrared light onto the strand and reflecting infrared light to an infrared receiver for detecting infrared light reflected to the receiver by the strand if the strand is present within the sensing range of the sensing means.

9. A method according to claim 5, wherein the method includes the step of pivotally positioning strand breaking means with relation to the path of movement of the strand for pivotal movement of the strand breaking means in the direction of movement of the strand and into the path of movement of the strand for breaking the strand upstream of the take-up package.

* * * * *